US007857873B2

(12) United States Patent
Hutchison

(10) Patent No.: US 7,857,873 B2
(45) Date of Patent: Dec. 28, 2010

(54) FLUE CLEANER

(76) Inventor: Peter Leonard Hutchison, 19 Frances Street, Gelorup WA 6230 (AU)

( * ) Notice: Subject to any disclaimer, the term of this patent is extended or adjusted under 35 U.S.C. 154(b) by 825 days.

(21) Appl. No.: 10/821,902

(22) Filed: Apr. 9, 2004

(65) Prior Publication Data

US 2005/0223634 A1 Oct. 13, 2005

(51) Int. Cl.
*C10L 10/00* (2006.01)

(52) U.S. Cl. ..... 44/640

(58) Field of Classification Search ..... 44/640
See application file for complete search history.

(56) References Cited

U.S. PATENT DOCUMENTS 2,014,686 A 9/1935 Lubovitch et al.
4,019,493 A * 4/1977 McCullough ..... 126/541
4,442,024 A * 4/1984 Crone, Jr. ..... 502/334
4,481,010 A 11/1984 Mackowiak et al.
4,571,247 A 2/1986 Barbieri
5,882,365 A * 3/1999 Farjon et al. ..... 44/535
6,129,774 A * 10/2000 Owens ..... 44/629

* cited by examiner

*Primary Examiner*—Cephia D Toomer
(74) *Attorney, Agent, or Firm*—Gottlieb, Rackman & Reisman

(57) ABSTRACT

A flue cleaner comprising a containment vessel having an opening providing restricted communication between the interior and exterior of the vessel, the vessel being formed of a non-combustible heat resistant material, the interior of the vessel containing a soot removal agent.

21 Claims, 2 Drawing Sheets

FLUE CLEANER

FIELD OF THE INVENTION

The invention relates to a flue cleaner which can be used with a stove or fireplace for the purposes of clearing soot and residues from the chimney associated with that stove or fireplace.

DISCLOSURE OF THE INVENTION

Accordingly the invention resides in a flue cleaner comprising a containment vessel having an opening providing restricted communication between the interior and exterior of the vessel, the vessel being formed of a non-combustible heat resistant material, the interior of the vessel containing a soot removal agent.

According to a preferred feature of the invention the containment vessel is formed of metal. According to one embodiment the containment vessel is formed of steel.

According to a preferred feature of the invention the vessel comprises a length of tube, at least one end of the tube being open, at least one end being partially closed by an inwardly directed flange to define the opening.

According to a preferred feature of the invention the opening is closed by a closure formed of a material which will be consumed slowly upon the flue cleaner being placed in a fire.

According to a preferred feature of the invention the soot removal agent is encased within the vessel within a settable composition which will harden once being introduced into the vessel and which will be consumed slowly upon the flue cleaner being placed in a fire. According to one embodiment the settable composition comprises a mixture of sawdust and a binding agent. According to a preferred feature of the invention the composition controls and restricts the combustion of the sawdust when the flue cleaner is placed in a fire.

According to a preferred feature of the invention wherein the soot removal agent is selected from zinc, tin, aluminium or any combination thereof.

According to a preferred feature of the invention the soot removal agent is coated on a substrate. According to a preferred feature of the invention the substrate comprises a metal foil and/or sheeting.

According to a preferred feature of the invention the soot removal agent comprises a quantity of particles and/or granules of the soot removal agent.

According to a preferred feature of the invention the soot removal agent is formed as a single body. According to one embodiment the soot removal agent is formed as an ingot.

The invention will be more fully understood in the light of the following description of several specific embodiments.

BRIEF DESCRIPTION OF THE DRAWINGS

The description is made with reference to the accompanying drawings of which.

DETAILED DESCRIPTION OF SPECIFIC EMBODIMENT

Each of the embodiments is directed to a flue cleaner which is intended to be placed in the fire in a stove or a fireplace for the purposes of clearing soot and/or residues which can accumulate in a chimney associated with that stove or fireplace.

Figure 1:
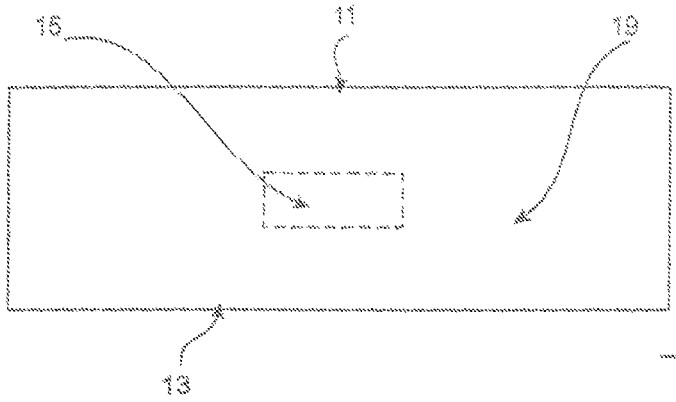
FIG. 1 is a schematic plan view of a flue cleaner according to the first embodiment.
Figure 2:
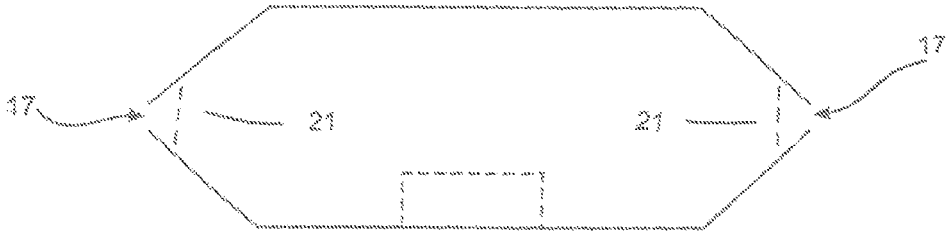
FIG. 2 is a schematic side elevation of a flue cleaner according to the first embodiment.
Figure 3:
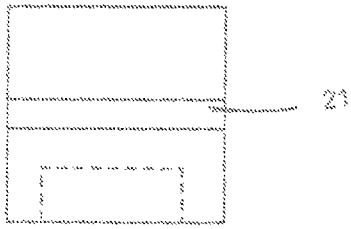
FIG. 3 is a schematic end elevation of a flue cleaner according to the first embodiment.

The flue cleaner according to the first embodiment as shown at FIGS. 1, 2, and 3 comprises a containment vessel 11 formed by a length of tube 13 which is partially closed at each end. The tube 13 is are formed of mild steel or any other suitable form of metal which is non-combustible and will resist the heat generated by a fire in a stove or fireplace. The interior of the vessel 11 as defined by the interior of the tube 13 accommodates a soot removal material which in the case of the embodiment comprises a metal ingot 15 which is accommodated within the interior of the vessel 11.

The metal ingot is retained in the tube by being encased within a mixture of a settable composition being a mixture of sawdust and a binding agent which will harden once being introduced into the vessel 11.

In use the flue cleaner according to the embodiment is placed in a stove and/or fireplace either during the building of the fire or while the fire is burning. On being placed into the fire the plugs 21 will be consumed by the fire and the interior of the containment vessel 11 will be heated to cause the melting and subsequent vaporisation of the metal of the metal ingot. On vaporisation the vapours will be permitted to exhaust from the interior of the vessel through openings 17 into the fire and to be carried by the combustion gases into the chimney for the purposes of clearing soot and residue.

Figure 4:
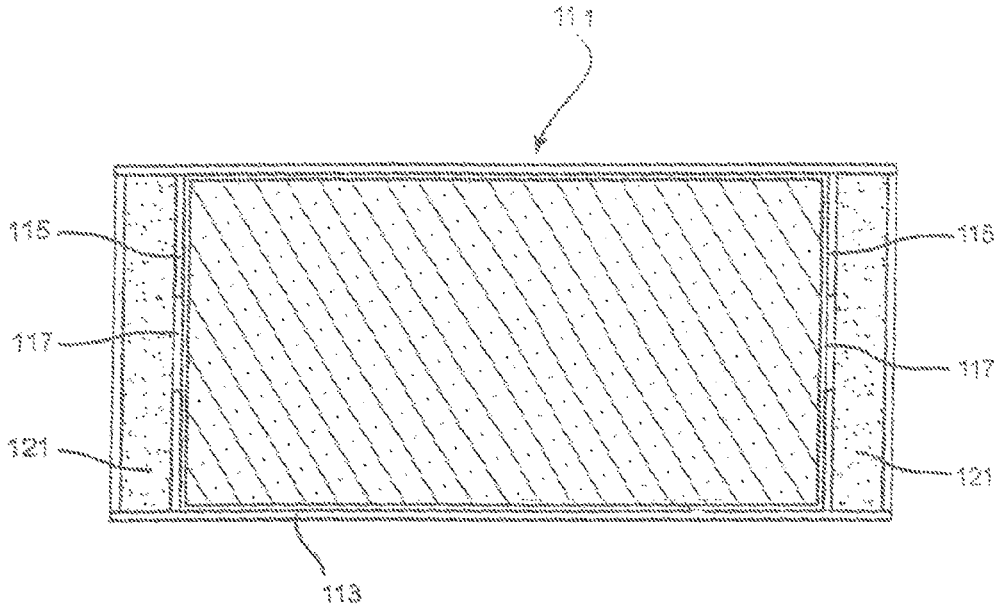
FIG. 4 is a schematic sectional elevation of a flue cleaner according to the second embodiment.

The flue cleaner according to the second embodiment shown at FIG. 4 comprises a containment vessel 111 formed by a length of tube 113 which is open at each end. Each end of the tube 113 supports an inwardly directed flange 115 at a position spaced short distance inwardly from the open end to provide a central opening 117 at each end. The tube 113 and the flange 115 are formed of mild steel or any other suitable form of metal which is non-combustible and will resist the heat generated by a fire in a stove or fireplace. The interior of the vessel 111 as defined by the interior of the tube 113 and the inner face of the flanges 115 accommodates a soot removal material which in the case of the second embodiment as shown in the drawing comprises tin plate which is formed into a loose roll to be accommodated within the interior of the vessel 111. Alternatively the soot removal agent can comprise a metal ingot as described in relation to the first embodiment encased within a mixture of a settable composition being a mixture of sawdust and a binding agent which will harden once being introduced into the vessel. The open end portions of the tube 113 which are axially outward of the flanges 115 are closed by a closure plug 121 which is formed from a mixture comprising a settable composition being a mixture of sawdust and a binding agent which is applied to each end of the tube 113 to close the ends thereof and which will harden to close the ends.

It should be appreciated that any suitable form of soot removal material can be accommodated by the containment vessel for the purposes of the embodiment and such materials can comprise tin or materials containing tin (such as tin plate), zinc and/or materials containing zinc (such as galvanised iron), aluminium and/or materials containing aluminium and/or any combination of the above materials.

Figure 5:
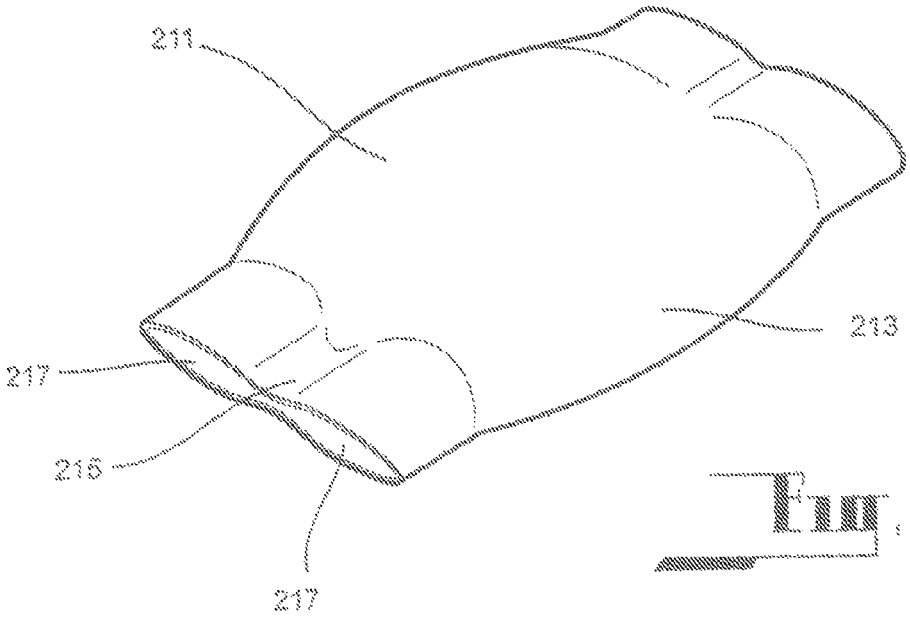
FIG. 5 is an isometric view of a flue cleaner according to the third embodiment.

The flue cleaner according to the third embodiment shown at FIG. 5 comprises a containment vessel 211 formed by a length of tube 213 which is open at each end. The tube is of generally of elliptical cross-section with the major axis adapted to be oriented in a substantially horizontal alignment. Each end is configured with a central portion 215 of very narrow opening while to either side the opening 217 is expanded somewhat to provide a substantially dumbbell or "figure-8" shaped profile. While any of the soot removal materials previously mentioned may be used in this embodiment, this embodiment has been found to be very effective when metallic tin is used as the soot removal material. When used in this way, tin will melt from the heat of a conventional fire. Therefore the containment vessel 211 must be maintained in a substantially horizontal orientation when in use. When the fire is extinguished, the tin will solidify again and the vessel can be moved if necessary without concern.

Again as a result of the configuration of the containment vessel of the third embodiment, the soot removal material within the vessel 211 is released in a restricted manner. Thus the device can be effective for an extended period of time, typically in the order of several months, without attention.

Throughout the specification, unless the context requires otherwise, the word "comprise" or variations such as "comprises" or "comprising", will be understood to imply the inclusion of a stated integer or group of integers but not the exclusion of any other integer or group of integers.

It should be appreciated that the scope of the present invention need not be limited to the particular scope of the embodiment described above. In particular the containment vessel can take any desired form and shape that is considered appropriate.

I claim:

1. A flue cleaner comprising an enclosed container having an opening providing restricted communication between the interior and exterior of the enclosed container, the enclosed container being formed of a non-combustible heat resistant material for placement in a fuel burning stove or fireplace, said material having a melting point sufficient to withstand the heat of a fire in said stove or fireplace, the interior of the enclosed container containing a sacrificial soot removal agent which is melted and then vaporized when heated by the fire in the stove or fireplace so as to generate cleaning vapors, said enclosed container and said opening being sized and shaped to exhaust said vapors from said enclosed container so as to clean the flue of the stove or fireplace.

2. A flue cleaner as claimed at claim 1 wherein the enclosed container is formed of metal.

3. A flue cleaner as claimed at claim 1 wherein the enclosed container is formed of steel.

4. A flue cleaner as claimed at claim 1 wherein the opening is closed by a closure formed of a material which will be consumed slowly upon the flue cleaner being placed in a fire.

5. A flue cleaner as claimed at claim 1 wherein the soot removal agent is encased within the enclosed container within a settable composition which will harden once being introduced into the enclosed container and which will be consumed slowly upon the flue cleaner being placed in a fire.

6. A flue cleaner as claimed at claim 5 wherein the composition comprises a mixture of sawdust and a binding agent.

7. A flue cleaner as claimed at claim 6 wherein the composition controls and restricts the consumption of the soot removal agent when the flue cleaner is placed in a fire.

8. A flue cleaner as claimed at claim 1 wherein the soot removal agent is selected from zinc, tin, aluminum or any combination thereof.

9. A flue cleaner as claimed at claim 1 wherein the soot removal agent is coated on a substrate.

10. A flue cleaner as claimed at claim 9 wherein the substrate comprises a metal foil and/or sheeting.

11. A flue cleaner as claimed at claim 1 wherein the soot removal agent comprises a quantity of particles and/or granules of the soot removal agent.

12. A flue cleaner as claimed at claim 1 wherein the soot removal agent is formed as a single body.

13. A flue cleaner as claimed at claim 12 wherein the soot removal agent is formed as an ingot.

14. A flue cleaner as claimed at claim 1 wherein the enclosed container comprises a length of tube, at least one end of the tube being open.

15. A flue cleaner as claimed at claim 14 said at least one end being partially closed.

16. A flue cleaner as claimed at claim 15 said at least one end being partially closed by an inwardly directed flange to define the opening.

17. A flue cleaner as claimed at claim 15 wherein the at least one end is closed by crimping the at least one end.

18. A flue cleaner as claimed at claim 1 wherein said soot removing agent generates soot removing vapors when subjected to heat to clear soot and residue; and wherein said opening is sized and shaped to restrict the release of said vapors to render the flue cleaner effective for an extended period of time.

19. A flue cleaner comprising a containment vessel arranged and constructed for placement in a fuel burning stove or fireplace and having an opening providing restricted communication between the interior and exterior of the vessel, the vessel being formed of a non-combustible heat resistant material, said material having a melting point sufficient to withstand the heat of a fire in said stove or fireplace, the interior of the enclosed container containing a sacrificial soot removal agent which is melted and then vaporized when said container is placed in the fire so as to generate soot removing vapors;

wherein the vessel comprises a length of tube, at least one end of the tube being partially closed by an inwardly directed flange to define the opening, said opening releasing said vapors from said containment vessel so as to clean the flue of the stove or fireplace.

20. A flue cleaner for cleaning the flue or chimney of a fuel burning stove or fireplace while a fire is burning therein, said flue cleaner comprising:

an enclosed container forming a containment vessel made of a non-combustible heat resistant material, said material having a melting point sufficient to withstand the heat of a fire in said stove or fireplace; and a sacrificial soot removing agent which is melted and then vaporized when subjected to heat so as to generate soot removing vapors to clear soot and residue from the flue or chimney of the stove or fireplace;

wherein said containment vessel has opening means sized and shaped to release said vapors from said containment vessel in a restricted manner to render the flue cleaner effective for an extended period of time when said enclosed container is disposed in the stove or fireplace.

21. A flue cleaner as claimed at claim 17 wherein the tube has a substantially elliptical cross-section and each end is provided with a dumbbell or "figure-8" profile.

* * * * *